US005407324A

United States Patent [19]

Starnes, Jr. et al.

[11] Patent Number: 5,407,324

[45] Date of Patent: Apr. 18, 1995

[54] SIDE-VENTED AXIAL FAN AND ASSOCIATED FABRICATION METHODS

[75] Inventors: Willie L. Starnes, Jr., Spring; James M. Webster, Houston, both of Tex.

[73] Assignee: Compaq Computer Corporation, Houston, Tex.

[21] Appl. No.: 176,275

[22] Filed: Dec. 30, 1993

[51] Int. Cl.[6] ..... F04D 29/54

[52] U.S. Cl. ..... 415/208.5; 415/209.1; 415/214.1; 415/223; 29/888.025

[58] Field of Search ..... 415/208.5, 209.1, 214.1, 415/223, 220, 211.1; 416/247 R; 29/888.025, 888.02, 423, 525, 509

[56] References Cited

U.S. PATENT DOCUMENTS

| | | | |
|---|---|---|---|
| 3,173,605 | 3/1965 | Harris | 415/220 |
| 4,244,096 | 1/1981 | Kashichi | 29/453 |
| 4,724,747 | 2/1988 | Sturm et al. | 416/247 R |
| 5,288,203 | 2/1994 | Thomas | 415/214.1 |
| 5,292,088 | 3/1994 | Lemont | 416/247 R |

FOREIGN PATENT DOCUMENTS

| | | | |
|---|---|---|---|
| 2604492 | 4/1988 | France | 415/214.1 |
| 32949 | 3/1978 | Japan | 415/214.1 |
| 629383 | 9/1949 | United Kingdom | 415/211.1 |

*Primary Examiner*—Edward K. Look
*Assistant Examiner*—James A. Larson
*Attorney, Agent, or Firm*—Konneker Bush Hitt & Chwang

[57] ABSTRACT

An axial flow cooling fan includes a rectangular housing base portion and a plurality of rectangular plate members, all having corner portions and central circular air flow openings. The plate members have corner openings and integral hollow cylindrical spacer members formed on side surfaces of their corner portions and aligned with their corner openings. To construct the housing subassembly the base portion post members are sequentially inserted through the corner openings of each plate member. Resilient finger structures on the outer ends of the post members create a snap-fitted locking engagement with the outermost plate member and anchor the plate members in a stacked, parallel relationship in which the installed plate members are held apart by their integral spacer portions to create side air inlet openings on the subassembly at edge portions of the stacked plate members. The housing base portion has a motor-driven impeller section operatively supported within its central air flow opening. Peripheral portions of the plate members and the housing base portion, surrounding their central openings, are preferably sloped in a downstream direction. Interfitting dimples and projections on the plate members and the housing base portion are provided to prevent an inadvertently reversed installation orientation of any of the plate members.

11 Claims, 3 Drawing Sheets

SIDE-VENTED AXIAL FAN AND ASSOCIATED FABRICATION METHODS

BACKGROUND OF THE INVENTION

1. Field of the Invention

The present invention relates generally to fan apparatus, and more particularly relates to a side-vented axial fan and methods of fabricating it.

2. Description of Related Art

Small axial flow fans are typically used in a variety of cooling applications such as in various computer system components including computer housings, printer housings and monitor housings. Conventional axial fans of this type typically include a molded plastic housing through which the axial air flow opening extends, and an electric motor-driven bladed impeller centrally supported within the unitary housing structure.

In small axial cooling fans of this general type a recent design proposal has been made to lower the operating noise and increase the overall air flow rate of such fans by forming side inlet openings in the fan housing so that during fan operation air is drawn into the side inlet openings and flowed through the rotating impeller section together with the air flow axially entering the fan as conventionally constructed.

Under this recent design proposal a rectangular outlet side portion of the fan housing is provided with a spaced set of posts projecting outwardly therefrom in an upstream direction relative to the ultimate axial air flow through the housing. A plurality of rectangular plate members having central air flow openings and corner connection openings therein are provided together with a plurality of separate hollow cylindrical spacer members.

The post members are passed through the plate member corner openings and the separate spacer members in a manner such that the plate members are in a stacked, parallel array and mutually separated by the separate spacer members to define between the plate members the desired side inlet openings of the overall fan housing. To retain them on the post members the plate members and the separate spacer members are glued in place on the post members.

This has been found to be a rather tedious and time-consuming fabrication process and presents several other problems as well. For example, it has been found desirable from an aerodynamic standpoint to slope annular portions of the plate member, which circumscribe the central openings of the plate members, in a radially inward and downstream direction. This leads to the possibility of inadvertently installing one or more of the plate members in a reversed orientation on the post members.

Additionally, in some housing configurations side inlet openings of different widths have been investigated. This design undesirably necessitates the provision of differently configured separate spacer members, and also requires that the spacer members be installed on the post members in a predetermined sequence. If this sequence is not adhered to the designed for side inlet spacing configuration is not achieved.

From the foregoing it can readily be seen that it would be desirable to provide improved methods of fabricating a side-vented axial fan of the general type described above which eliminates or at least substantially reduces the problems, limitations and disadvantages associated with the described fabrication method.

It is accordingly an object of the present invention to provide such improved methods together with a side-vented axial fan constructed thereby.

SUMMARY OF THE INVENTION

In carrying out principles of the present invention, in accordance with a preferred embodiment thereof, a side-vented axial flow fan is fabricated by providing a housing base portion having first and second opposite sides between which a central air flow opening extends, and operatively mounting a motor driven axial fan impeller centrally on the housing base portion.

Side air inlet openings are formed in the housing portion of the fan, preferably by providing a spaced plurality of post portions projecting outwardly from an inlet side of the housing base portion, and extending the post portions through connection openings in a plurality of plate members having central air flow openings therein. The plate members are retained in a stacked, parallel orientation on the post portions, and the post portions have outer ends that are in a snap-locked relationship with the outermost plate member. Integral spacer portions of the plate members hold the plate members in a laterally spaced relationship on the housing base portion, thereby creating housing side air inlet openings between edge portions of the plate members. The base portion and the plate members are aligned and form an axial air flow passage through the overall fan housing structure.

According to a feature of the invention the stacked plate members have annular portions surrounding their central air flow openings and laterally offset toward the housing base member, and cooperatively interengaged means are formed on the base portion and the plate members and function to prevent any of the plate members from being installed on the post portions in a manner such that the plate member annular portion projects away from the housing base portion.

Representatively, these cooperatively interengaged means comprise dimples formed on the sides of the base portion and the plate members which face away from the housing base member, and projections formed on the plate members on the sides thereof that face the housing base member, the projections being complementarily received in the dimples.

The snap-on connection of the side inlet-defining plate members to the post portions makes the assembly of the fan quite simple and fast. Preferably, the plate members are of identical configurations so that they do not have to installed on the post portions in any particular sequence.

DETAILED DESCRIPTION

Figure 1:
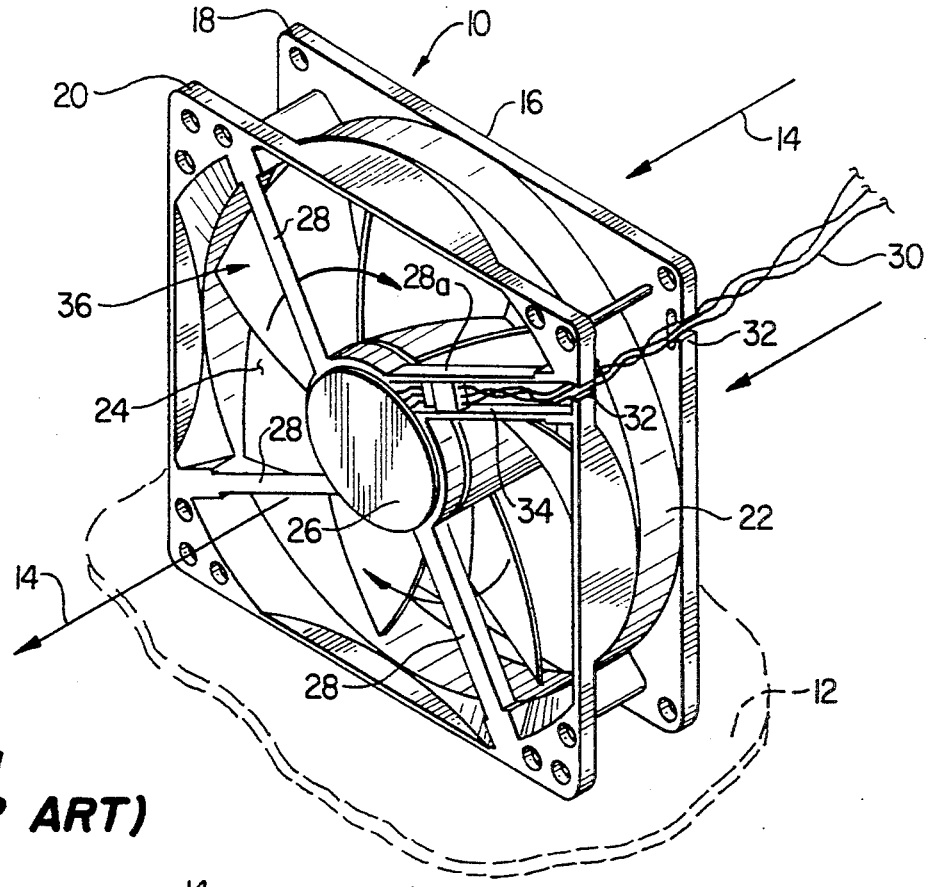
FIG. 1 (PRIOR ART)
FIG. 1 (PRIOR ART) is an outlet side perspective view of a conventional axial cooling fan representatively disposed in a computer housing.

Perspectively illustrated in FIG. 1 (PRIOR ART) is a conventionally constructed axial fan 10 which is representatively shown as being mounted in a computer housing 12 to provide a flow of cooling air 14 therethrough. Fan 10 includes a molded unitary plastic housing 16 having rectangular inlet and outlet side portions 18 and 20 separated by a circular intermediate housing portion 22 which circumscribes a circularly cross-sectioned air flow passage 24 axially extending centrally through the housing 16 between its inlet and outlet sides.

An electric fan motor 26 is centrally mounted on the housing outlet side portion 20 by spider arm support members 28. Electrical power is supplied to the motor 26 via appropriate electrical leads 30 routed through notches 32 in the housing side portions 18, 22 and the illustrated side recess 34 in the spider support member 28*a*. A bladed axial impeller 36 is positioned within the flow opening 24 and coupled to the motor 26 for driven rotation in the indicated direction to create the flow of cooling air 14 through the fan.

Figure 2:
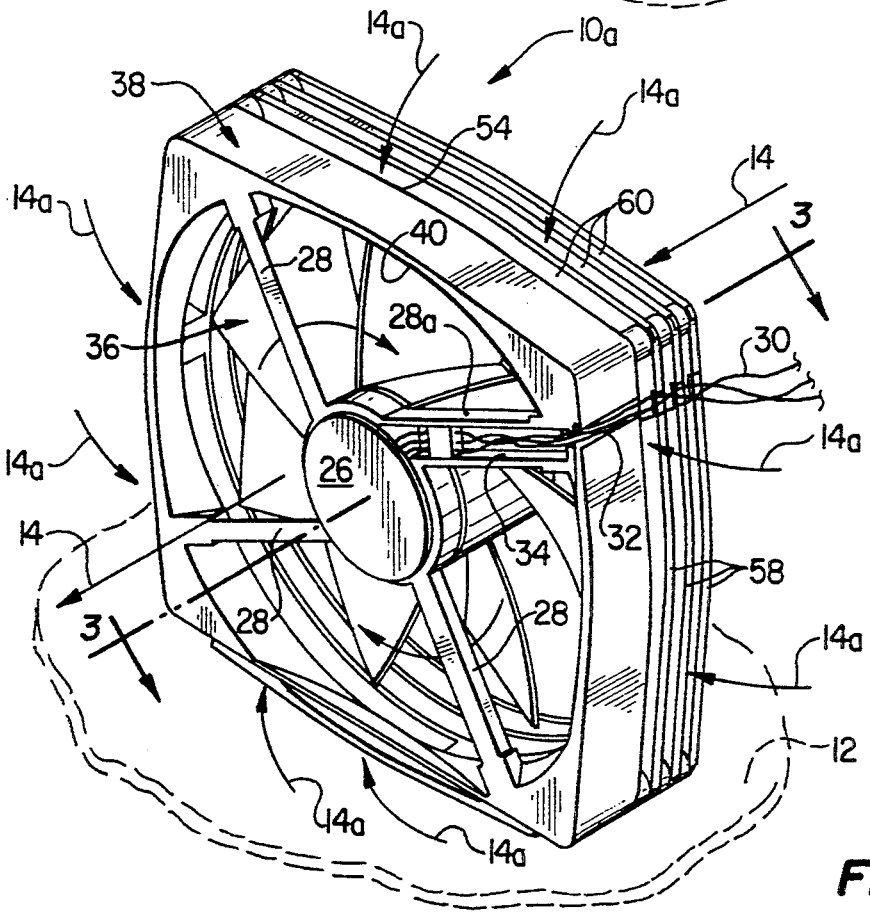
FIG. 2 is an outlet side perspective view of a side-vented axial cooling fan embodying principles of the present invention and representatively disposed in a computer housing.
Figure 4:
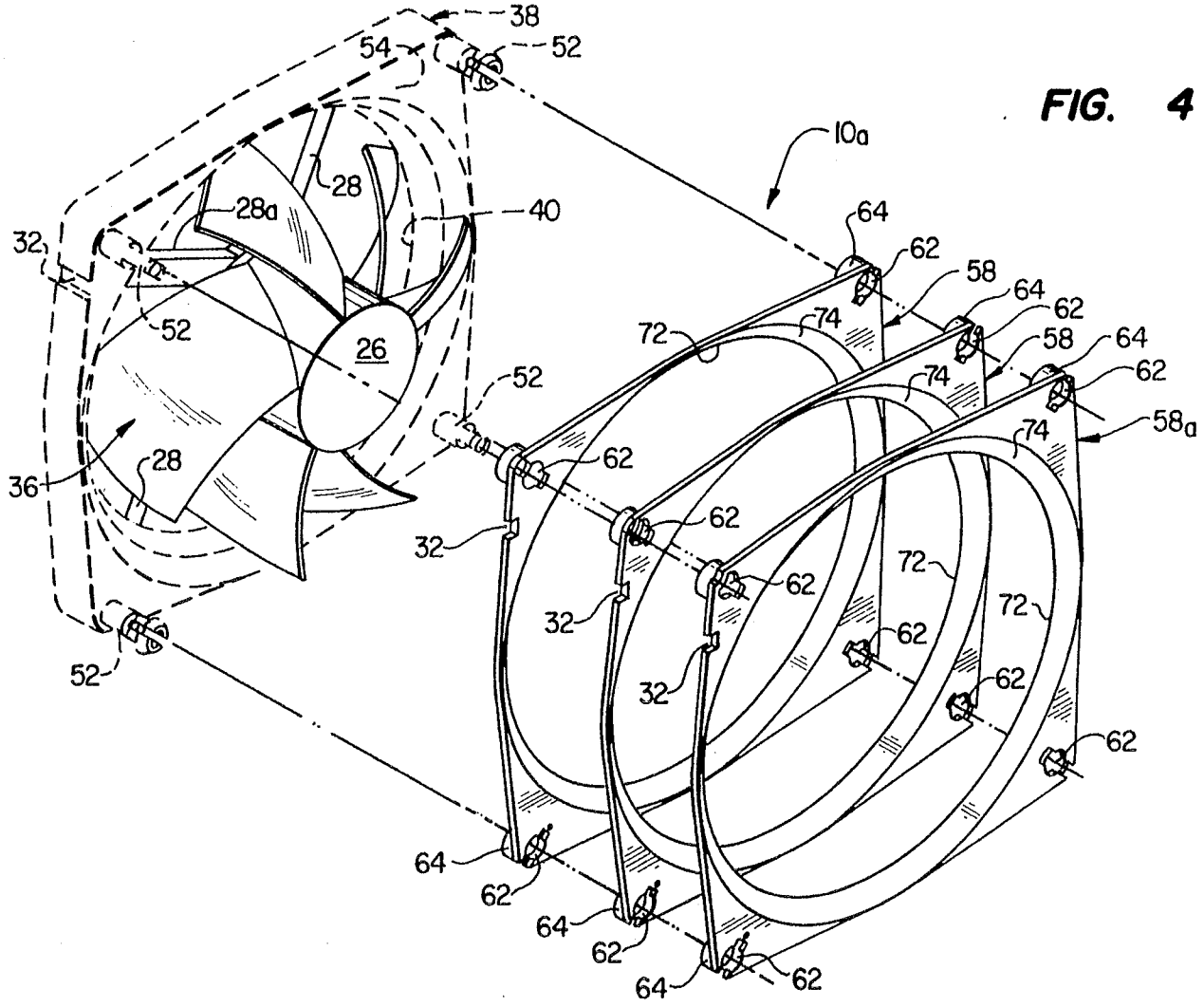
FIG. 4 is a partially phantomed exploded inlet side perspective view of the side-vented axial cooling fan.

Referring now to FIGS. 2 and 4, utilizing a unique fabrication method the present invention provides a side-vented axial fan 10*a* representatively having the same exterior size of the conventional fan 10 and useable in a variety of cooling applications such as within the schematically illustrated computer housing 12. The side-vented axial fan 10*a* of the present invention has a generally rectangular molded plastic housing base member 38. Spider support arms 28 extend across a central circular opening 40 in the base member 38 and centrally support the previously described electric motor 26 and its associated bladed axial impeller 36.

The base member 38 has cylindrical post members 52 transversely projecting outwardly from the corner portions of its inlet side 54. In a manner subsequently described, these post members are used to snap-fittingly secure three rectangular molded plastic plate members 58 to the inlet side of the base portion 38. The molded plastic plate members 58 create around the periphery of the fan 10a auxiliary housing side inlet openings 60 which provide for additional throughflows 14*a* of cooling air during operation of the fan 10*a*. In addition to increasing the overall flow of cooling air through the fan 10*a*, these side inlet openings also desirably reduce the operational noise of the fan 10*a*. While three of the plate members 58 have been representatively illustrated herein, and create three sets of auxiliary inlet openings 60 around the lateral housing side periphery of the fan 10*a*, it will be readily appreciated that a greater or lesser number of plate members 58 could be used if desired.

Figure 5:
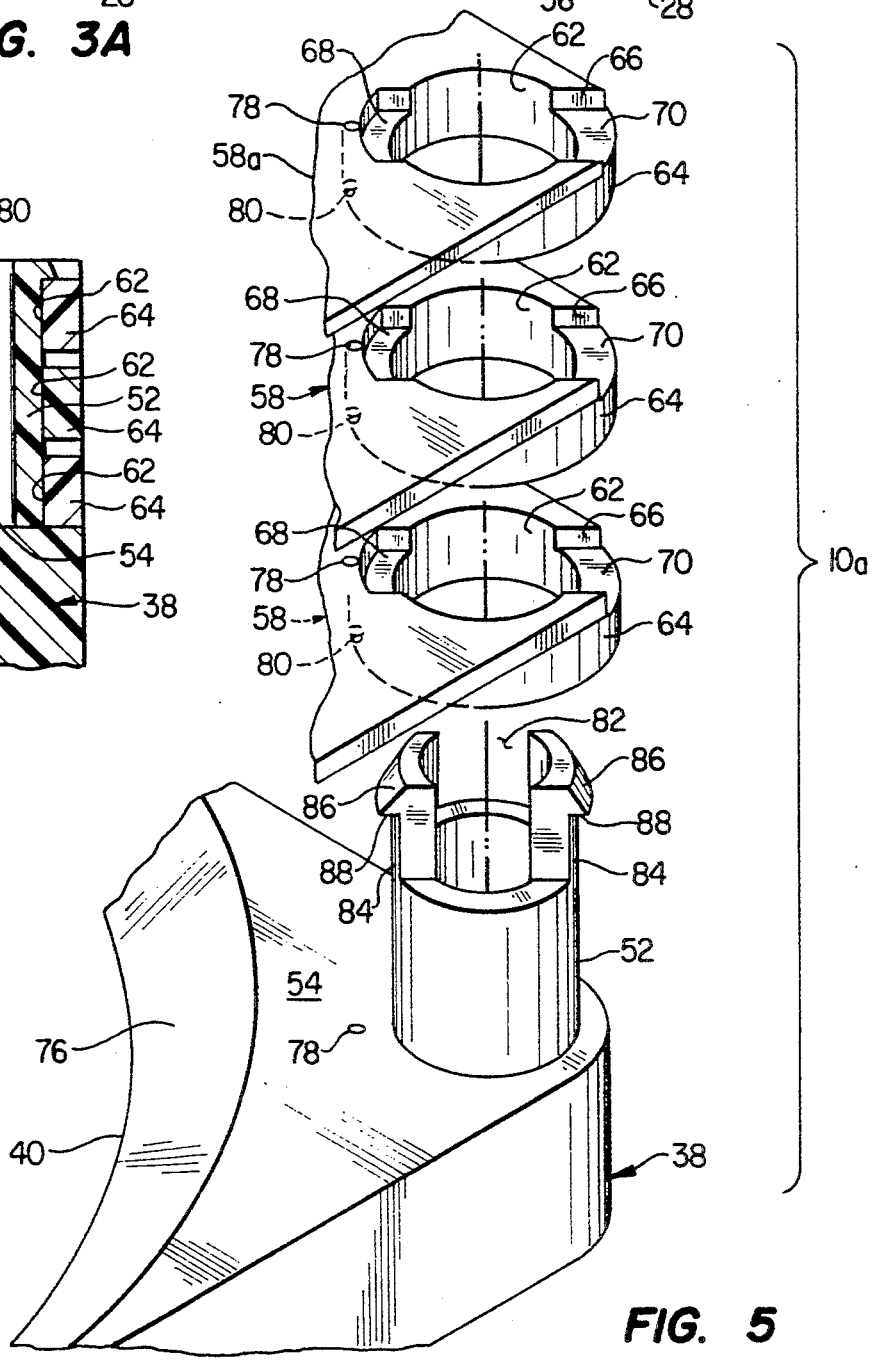
FIG. 5 is an enlarged scale exploded perspective view of a corner portion of the side-vented axial cooling fan.

As best illustrated in FIGS. 4 and 5, each of the plate members 58 has corner openings 62 that extend through hollow cylindrical spacer members 64 integrally formed on and projecting outwardly from its outlet side. Generally diametrically directed depressions 66 extend across the openings 62, across the inlet sides of the plates 58, and form recessed ledges 68 and 70 on opposite sides of each opening 62.

Each of the plate members 58 has a central circular air flow opening 72 which is bounded by an annular peripheral area 74. Peripheral areas 74, like the similar annular peripheral area 76 surrounding the opening 40 in the housing base portion 38, are radially inwardly and axially sloped toward the outlet side of the fan 10*a* to improve the aerodynamic characteristics of the fan. For purposes later described, a small partially spherical dimple is formed on the inlet side of each of the plate members 58 and overlies a complementarily configured, partially spherical projection or boss 80 formed on the outlet side of the spacer member 64. As best illustrated in FIG. 5, partially spherical dimples 78 are also formed on the inlet side 54 of the housing base portion 38 inwardly adjacent its post members 52.

Still referring to FIG. 5, each of the four hollow cylindrical post members 52 has a notch 82 formed in its outer end. Each notch 82 forms a diametrically opposed pair of axially extending resilient fingers 84 at the outer end of the post member . Each of the fingers 84 has an enlarged outer end having a tapered peripheral portion 86, and a ledge portion 88 underlying the tapered portion 86. A circular opening 90 is formed through each of the four corner portions of the skirted base member 44 and forms a continuation of the interior of the post member 52 on such corner portion.

Figure 3A:
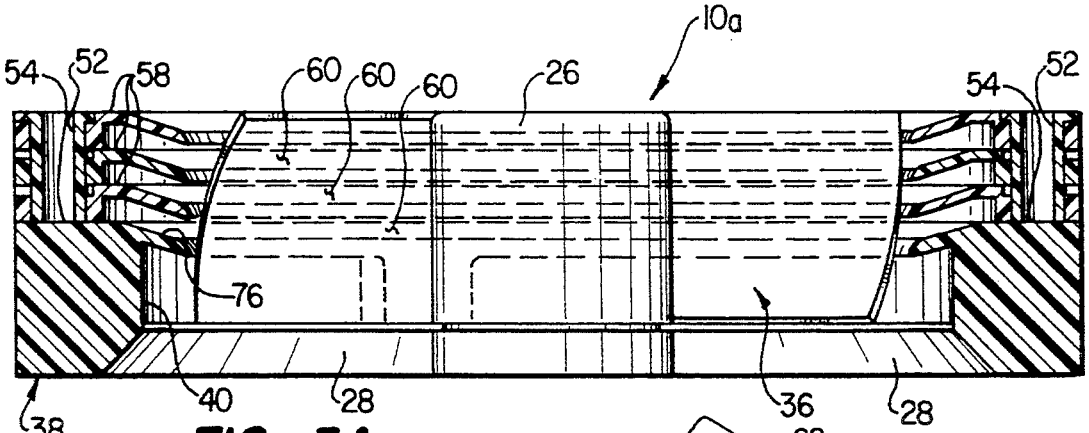
FIG. 3A is an enlarged scale cross-sectional view through the side-vented axial cooling fan taken along line 3—3 of FIG. 2.
Figure 3B:
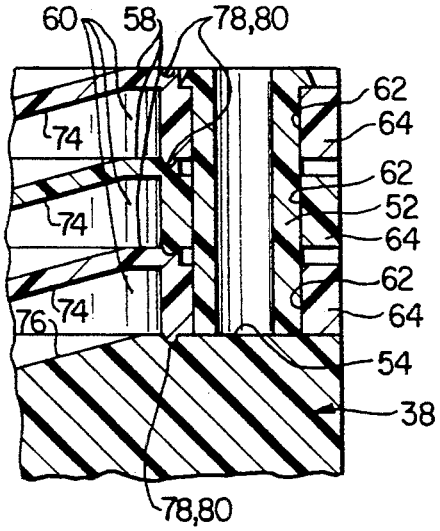
FIG. 3B is an enlargement of a corner portion of the fan cross-sectionally illustrated in FIG. 3A.

Turning now to FIGS. 3A, 3B and 5, in constructing the side vented axial fan 10*a* the housing base portion post members 52 are extended upwardly through the corner portion openings 62 of the plate members 58, with the spacer members 64 facing the inlet side 54 of the housing base portion 38. As the post member fingers 84 pass through the corner openings 62 of the outermost plate member 58*a* the enlarged outer ends of the fingers 84 snap into locking engagement within the depressions 66, with the ledge portions 88 of the fingers 84 closely overlying the plate member ledges 68, 70 at each corner of the plate member 58*a*.

This locks the stacked plate members 58 into place on the housing base portion 38 with each plate boss 80 being complementarily received within its associated underlying dimple 78. The integral spacer members 64 on each of the plate members 58 automatically create the side inlet openings 60 (see FIG. 2) through which the auxiliary flows 14*a* of air will pass during the operation of the completed fan 10*a*.

It can be seen that the fan fabrication method just described may be rapidly and quite easily carried out due to the unique snap-on assembly of the stacked plate members 58 which are automatically held in a predetermined spaced relationship by their integral spacer portions 64. The provision of the interfitting dimples and bosses 78, 80 assures that none of the plate members 58 can be installed in a reversed orientation. Additionally, since the plate members 58 have identical configurations, the plate members need not be positioned on the post members 52 in any particular order.

The foregoing detailed description is to be clearly understood as being given by way of illustration and example only, the spirit and scope of the present invention being limited solely by the appended claims.

What is claimed is:

1. A method of fabricating a side-vented axial flow fan comprising the steps of:

providing a housing base portion having opposite sides, a central air flow opening extending between said opposite sides, and a plurality of post members projecting outwardly from one of said opposite sides and mutually spaced around said central air flow opening;

centrally mounting a motor-driven axial fan impeller structure on said housing base portion;

providing a plurality of plate members each having opposite sides, a central air flow opening extending transversely therethrough, a plurality of spaced connection openings disposed outwardly of the plate member air flow opening, and a spaced plurality of hollow spacer portions extending outwardly from one of the plate member sides and aligned with its connection openings;

positioning said plurality of plate members on one of said opposite sides of said housing base portion, in a stacked, mutually parallel orientation in which said spacer portions separate said plate members to create at edge portions thereof side air inlet openings, by extending said post members through said spacer portions and said connection openings; and creating a snap-locked engagement between said post members and the outermost plate member in a manner locking said plate members in said stacked, mutually parallel orientation.

2. A side-vented axial flow fan fabricated by the method of claim 1.

3. The method of claim 1 wherein said step of creating a snap-locked engagement includes the steps of:

forming resilient fingers on the outer ends of said post members, forming recesses on one of said opposite sides of said plate members adjacent its connections openings, and causing portions of said resilient fingers to snap into said recesses.

4. A side-vented axial flow fan fabricated by the method of claim 3.

5. The method of claim 1 wherein:

said providing step is performed by providing a plurality of identically configured plate members.

6. A side-vented axial flow fan fabricated by the method of claim 5.

7. The method of claim 1 wherein:

said plate members have laterally offset, generally annular portions circumscribing their central openings, and said method further comprises the step of forming cooperatively interengageable means on said plate members and said housing base portion for preventing any of said plate members from being retained in said stacked, parallel plate member orientation with its laterally offset, generally annular portion extending in an opposite direction relative to the laterally offset, generally annular portion of any other of the plurality of plate members.

8. A side-vented axial flow fan fabricated by the method of claim 7.

9. A side-vented axial flow fan comprising:

a housing portion having first and second opposite sides, and an air flow opening extending through said housing portion between said first and second opposite sides thereof, and a spaced plurality of post members projecting outwardly from said second side;

a motor-driven axial fan impeller operatively supported within said air flow opening; and a plate member having a central opening extending transversely therethrough, a spaced plurality of connection openings positioned outwardly of the central plate member opening, and a spaced plurality of hollow spacer members interposed between a side of said plate member and said second side of said housing portion and maintaining a side air inlet opening between said housing portion and said plate member, said post members extending through said spacer members and said connection openings and having outer end portions disposed in a snap-locking relationship with said plate member and holding said plate member and said spacer members on said second side of said housing portion.

10. The side-vented axial flow fan of claim 9 wherein:

said spacer members are integral with said plate member.

11. The side-vented axial flow fan of claim 10 wherein:

said housing portion, said plate member and said spacer members are of a plastic material.

* * * * *